US006050744A

United States Patent [19]

Binning

[11] Patent Number: 6,050,744

[45] Date of Patent: Apr. 18, 2000

[54] PATH PAVER MACHINE

[76] Inventor: Burleigh Binning, 35 BD Blvd., P.O. Box 767, Pinedale, Wyo. 82941

[21] Appl. No.: 09/244,193

[22] Filed: Feb. 4, 1999

Related U.S. Application Data

[60] Provisional application No. 60/074,054, Feb. 9, 1998.

[51] Int. Cl.[7] ..... E01C 19/18

[52] U.S. Cl. ..... 404/108; 404/110

[58] Field of Search ..... 404/108, 110

[56] References Cited

U.S. PATENT DOCUMENTS

| | | | |
|---|---|---|---|
| 2,762,276 | 9/1956 | Mauch . | |
| 2,953,977 | 9/1960 | Warren . | |
| 3,230,845 | 1/1966 | Mauldin . | |
| 3,526,173 | 9/1970 | Brandstetter . | |
| 3,877,830 | 4/1975 | James, III | 404/84.1 |
| 3,989,402 | 11/1976 | James, III . | |
| 4,102,596 | 7/1978 | Itayama . | |
| 4,310,293 | 1/1982 | Eggleton . | |
| 4,329,081 | 5/1982 | Buvik . | |
| 4,496,265 | 1/1985 | Fragale . | |
| 4,878,778 | 11/1989 | Bresnahan . | |
| 5,059,062 | 10/1991 | Bresnahan . | |
| 5,190,400 | 3/1993 | Sterner . | |
| 5,533,829 | 7/1996 | Campbell . | |
| 5,556,227 | 9/1996 | Ulrich . | |
| 5,615,973 | 4/1997 | Campbell . | |

*Primary Examiner*—James A. Lisehora
*Attorney, Agent, or Firm*—Tipton L. Randall

[57] ABSTRACT

A paver machine for applying paving material to narrow paths is disclosed. The machine includes a storage hopper and frame elevated above a roadbed by at least three wheeled unit members. A free-floating screed assembly located beneath the hopper and pivotally attached to the frame applies a paving material matte to the roadbed as the paver machine is moved along by a front end loader or the like.

20 Claims, 14 Drawing Sheets

PATH PAVER MACHINE

CROSS REFERENCE TO RELATED APPLICATION

This application claims the benefit under 35 U.S.C. §119 (e) of co-pending provisional application Ser. No. 60/074,054, filed Feb. 9, 1998. Application Ser. No. 60/074,054 is hereby incorporated by reference.

FIELD OF THE INVENTION

The present invention relates to a paving machine and, more particularly, to a narrow paving machine suitable for paving a path of limited width.

BACKGROUND OF THE INVENTION

Machines for laying down asphalt, concrete and the like are well known. These machines are built to lay down a strip of paving material sufficiently wide to accommodate the normal passenger vehicle. The paving machines in present use are generally self propelled, and may have built in hydraulic or mechanical systems used in the paving process. As these paving machines become more complex, there is a greater probability that failure of one component of the machine will prevent the paver from performing properly.

Presently, there is a need for paving areas having a smaller width than that of the commercial paving machines designed for normal vehicle roads. The need exists in golf courses, parks, and nature preserves, as well as farms and residential dwellings. Some examples of innovative devices for applying paving material to a roadbed are shown in the following patents.

Some large and complicated devices for applying paving material are shown by Sterner in U.S. Pat. No. 5,190,400, by Campbell in U.S. Pat. Nos. 5,533,829 and 5,615,973, and by Ulrich in U.S. Pat. No. 5,556,227.

Buvik, in U.S. Pat. No. 4,329,081, discloses a device for laying road material that attaches to the bucket of an end loader. Eggleton discloses a motor powered concrete molding device in U.S. Pat. No. 4,310,293. In U.S. Pat. No. 4,496,265 Fragale describes a self-powered compact asphalt laying machine with motor and steering wheels. Bresnahan describes several concrete path paver devices using slip-form screeds in U.S. Pat. Nos. 4,878,778 and 5,059,062.

A paving machine with thickness and leveling control is disclosed by James, III, in U.S. Pat. No. 3,989,402. Both the hopper and screed are adjustable relative to the undercarriage of the device. Sensors for detecting terrain variation are also incorporated in this machine.

Thus, there exists an unmet need for a simple paving machine that is capable of laying a paving material on a roadbed of relatively narrow width, without disturbing the surrounding landscape to a great extent.

SUMMARY OF THE INVENTION

The present invention is a gravity feed free-floating screed paving machine for applying a paving material to a roadbed. The paving machine comprises a hollow storage hopper member with an open top end and a smaller open bottom end, the storage hopper member having front and rear panels and two side panels, with all panels tapering in width from the top end to the bottom end.

A frame member supports the storage hopper, with the frame member and attached storage hopper member elevated a selected distance above the roadbed by at least three wheeled unit members. The first and second wheeled unit members are attached adjacent to the storage hopper open bottom end in support thereof, and at least one third wheeled unit member is attached to the frame member opposite the storage hopper open bottom end.

A free-floating screed assembly is positioned below the elevated storage hopper member and elevated frame member. The screed assembly comprises a feed hopper means positioned in register with the storage hopper open bottom end. A pair of connecting arm members connect the feed hopper means to the frame member, with each arm member extending from the feed hopper means and pivotally connected at one end to the frame member at a point adjacent to the at least one third wheeled unit member. An adjustable screed plate member is fastened between the connecting arm members and positioned adjacent to the rear panel of the storage hopper bottom end. An adjusting means is present to vary the orientation of the screed plate member relative to a road bed. A floating hitch means is secured to and extends from the frame member opposite the storage hopper member for attachment to a means for pulling the paving machine over the roadbed.

DESCRIPTION OF THE PREFERRED EMBODIMENTS

Nomenclature

Figure 1:
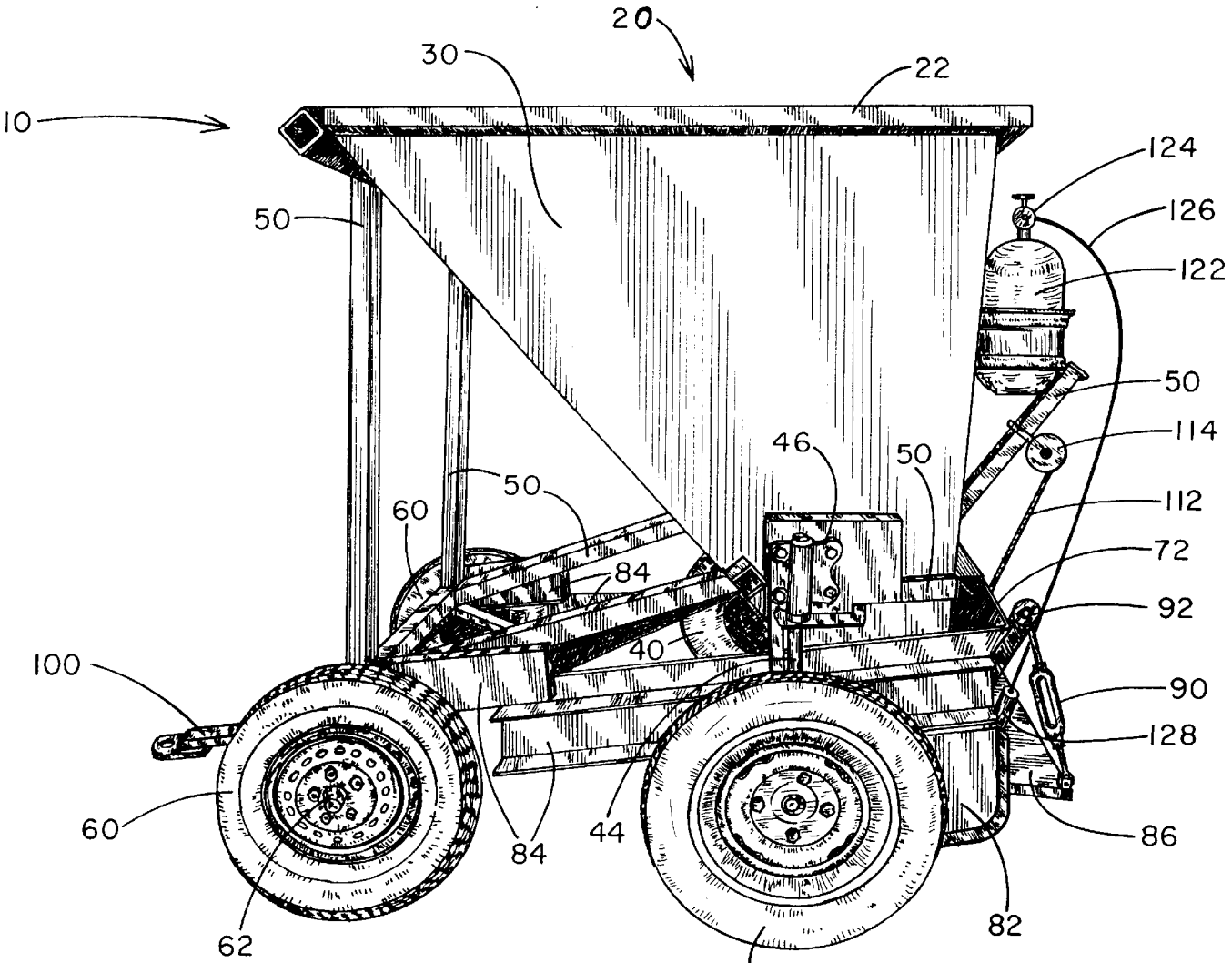
FIG. 1 is an elevational plan view of one embodiment of the paver machine of the present invention.

10 Paving Machine
20 Storage Hopper Member
22 Storage Hopper Open Top End
24 Storage Hopper Open Bottom End
26 Storage Hopper Front Panel
27 Bottom Extension of Front Panel
28 Storage Hopper Rear Panel

30 Storage Hopper Side Panels
40 First Pair of Wheel Members
42 Wheel Shaft with 90° Bend
44 Wheel Shaft Vertical Portion
46 Wheel Shaft Attachment Brackets
50 Frame Member
52 First Wheeled Unit Member
54 Second Wheeled Unit Member
56 Vertical Wheel Support Member
58 Third Wheeled Unit Member
60 Second Pair of Wheel Members
62 Frame Axle Member
70 Free-Floating Screed Assembly
72 Feed Hopper Member
74 Feed Hopper Open Top End
76 Feed Hopper Open Bottom End
78 Feed Hopper Front Panel
80 Feed Hopper Rear Panel
82 Feed Hopper Side Panels
84 Connecting Arm Members
86 Adjustable Screed Plate Member
87 Screed Plate Member Vent Holes
88 Hinge Connector Member
90 Turnbuckle Adjusting Members
92 Turnbuckle Attachment Arm Members
100 Floating Hitch Tongue
110 Cable Assembly
112 Cable
114 Cable Winch
120 Propane Heater Assembly
122 Propane Storage Tank
124 Propane Tank Regulator
126 Propane Feed Lines
128 Propane Burner Heads
130 Petroleum Liquid Wash Assembly
150 Ends of Triangular Screed Plate Member
152 Flat Bottom of Triangular Screed Plate Member
154 Vertical Front Side of Triangular Screed Plate Member
156 Angled Top Side of Triangular Screed Plate Member
160 Hinge and Pin Device
162 Hinge Receiver Device
164 Slot in Bracket Member
166 Bracket Member for Side Plate
168 Connecting Member
170 Threaded Shaft Member
172 Threaded Support Member
174 Handle on Shaft Member
RB Roadbed
P Paving Material Construction The path paver machine 10 of the present invention is shown in the accompanying Figures. The paver machine 10 is sized to lay down a matte of paving material from about four to six feet in width, having a depth of two to six inches. The paving material is fed by gravity through the paving machine 10, with the matte formed beneath the paving machine as the machine is moved along a roadbed by a separate vehicle, such as a tractor, front end loader, or the like.

One embodiment of the paver machine 10 comprises a hollow storage hopper member 20 with an open top end 22 and a smaller open bottom end 24. The storage hopper member 20 has a front panel 26, a rear panel 28, and two side panels 30. All the panels taper in size from the top end 22 to the bottom end 24 to funnel the paving material placed therein toward the bottom end 24.

The storage hopper member 20 is supported on a first pair of wheel members 40. Each wheel member 40 is attached to one hopper side panel 30 near the smaller bottom end 24 such that the hopper member 20 is elevated a selected distance above the roadbed RB. The wheel members 40 are each mounted on a wheel shaft 42 that has a right angle bend. The vertical portion 44 of the wheel shaft 42 is secured to the hopper side panel 30 by a wheel shaft attachment bracket 46. Each wheel member 40, wheel shaft 42 and attachment bracket 46 together constitute the first 52 and the second 54 wheeled unit members.

A frame member 50 supports the storage hopper 20 and wheel members 40 attached thereto in an upright position. The frame member 50 is secured around the lower portion of the storage hopper 20 and extends forward, beyond the tapered hopper member front panel 26 as seen in FIGS. 1–6. The frame member 50 is elevated a selected distance above the roadbed by a second pair of wheel members 60 attached to a frame member axle 62. The second pair of wheel members 60 and frame member axle 62 constitute a third wheeled unit member 58. The second pair of wheel members 60 are positioned in alignment with the first pair of wheel members 40 attached to the storage hopper member 20. This configuration produces a relatively open channel beneath the frame member 50 and the open end 24 of the storage hopper member 20. The open channel is the location of the free-floating screed assembly 70.

The free-floating screed assembly 70 is comprised of a generally rectangular feed hopper member 72 with an open top end 74 and a smaller open bottom end 76. The feed hopper member 72 has a front panel 78, a rear panel 80, and two side panels 82. The side panels 82 extend several inches below the front 78 and rear 80 panels and generally rest on the roadbed surface RB. The feed hopper member 72 is positioned with the open top end 74 directly below, or in register with, the storage hopper open bottom end 24. The feed hopper member 72 is connected to the frame member 50 by a pair of connecting arm members 84, one arm member extending from each feed hopper member side pane 82. The arm members 84 are pivotally connected at the end opposite the feed hopper member 72 to the frame member 50 at points adjacent to the frame wheel members 60. An adjustable, generally flat screed plate member 86 is secured at one edge to the feed hopper rear panel at the bottom end 76 thereof The screed plate member 86 is the same width as the open bottom end 76 of the feed hopper member 72, and is attached to the bottom end 76 of the hopper member 72 by a continuous hinge connector 88. The hinge connector 88 allows the screed plate member 86 to be pivotally adjustable relative to the roadbed RB beneath the paver 10. Positioning of the screed plate member 86 is accomplished by a pair of turnbuckle adjusting members 90, each turnbuckle 90 connected at one end to the edge of the screed plate member 86 opposite the hinge connector 88 and at the other end to an attachment arm member 92 extending from near the feed hopper open top end 74. These turnbuckle adjusting members 90 provide means to vary the orientation of the flat screed plate member relative to the road bed RB.

At the front end of the paver machine 10 is a floating tongue hitch 100 secured to and extending from the frame member 50 opposite the storage hopper member 20 for attachment to a powered vehicle that pulls the paving machine 10 over a roadbed RB to deposit a paving material P thereon.

Figure 2:
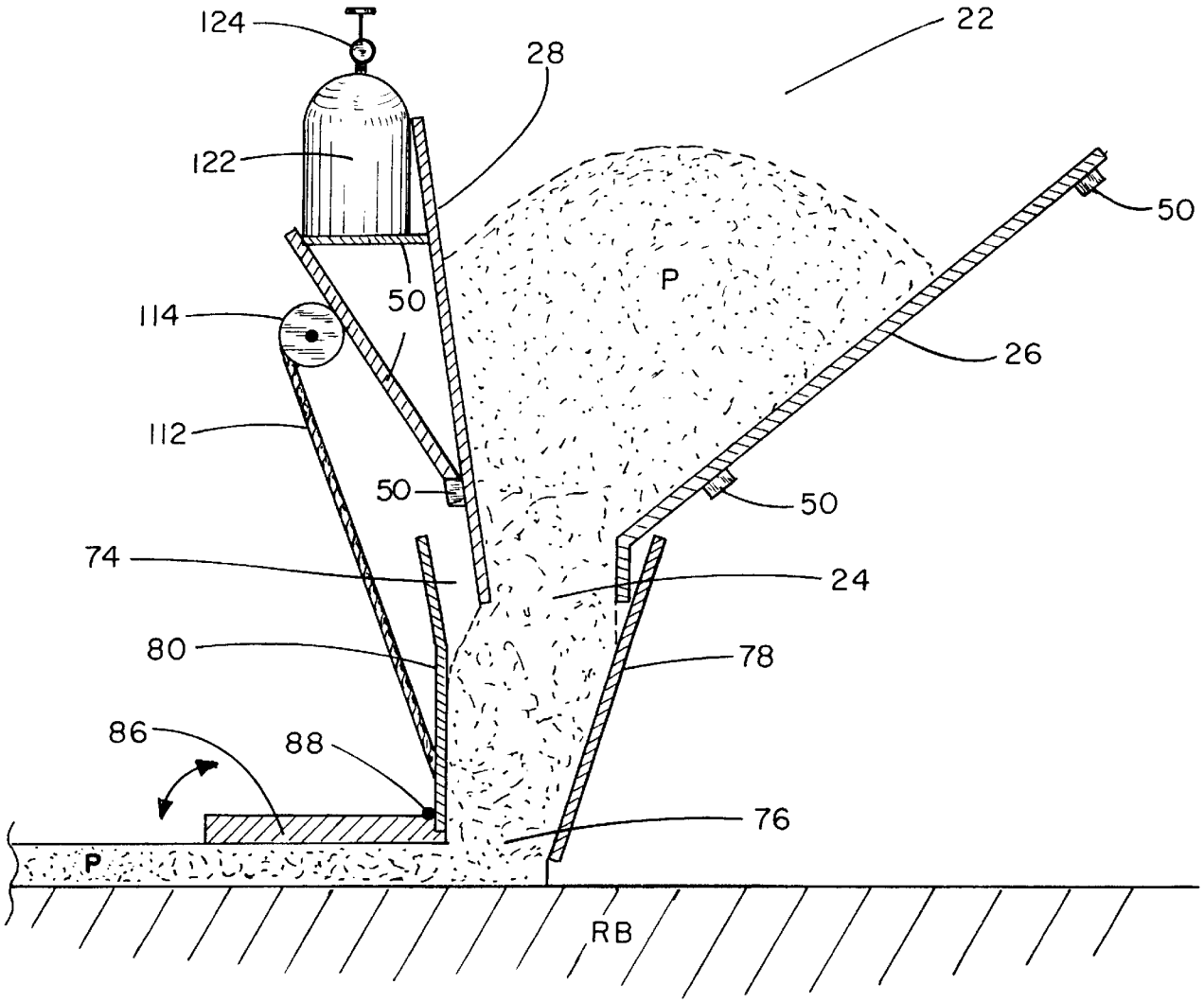
FIG. 2 is a sectional view of one embodiment of the paver machine during operation.
Figure 3:
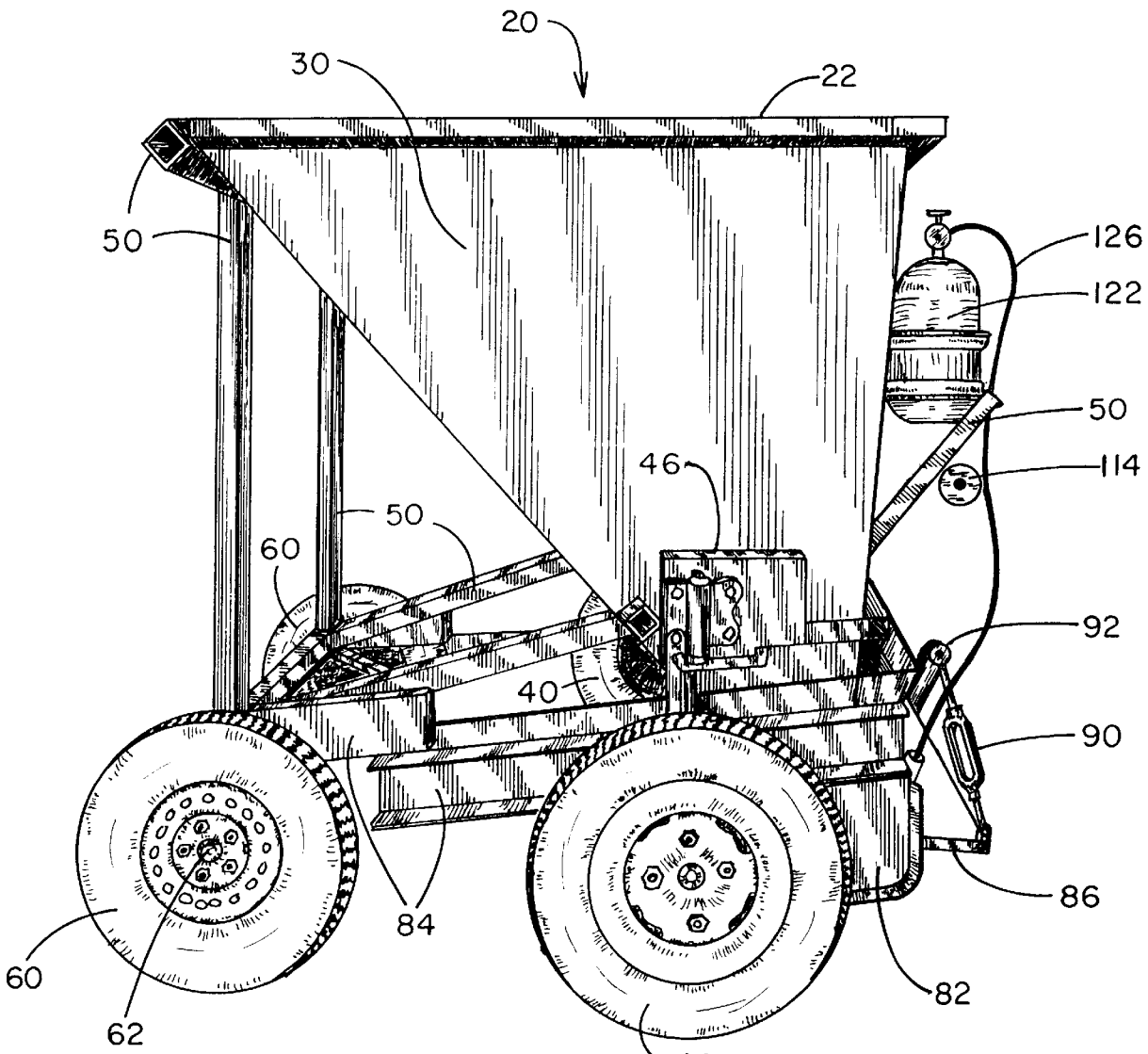
FIG. 3 is an elevational side view of one embodiment of the paver machine.
Figure 4:
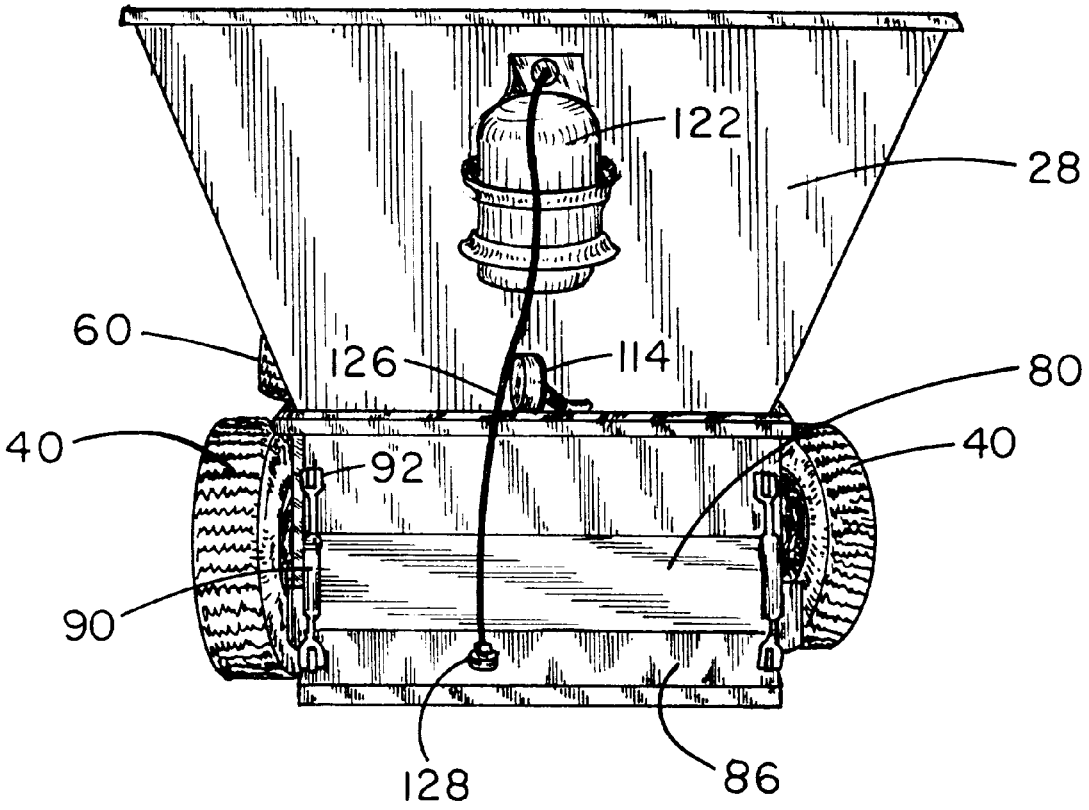
FIG. 4 is an elevational rear view of one embodiment of the paver machine.
Figure 5:
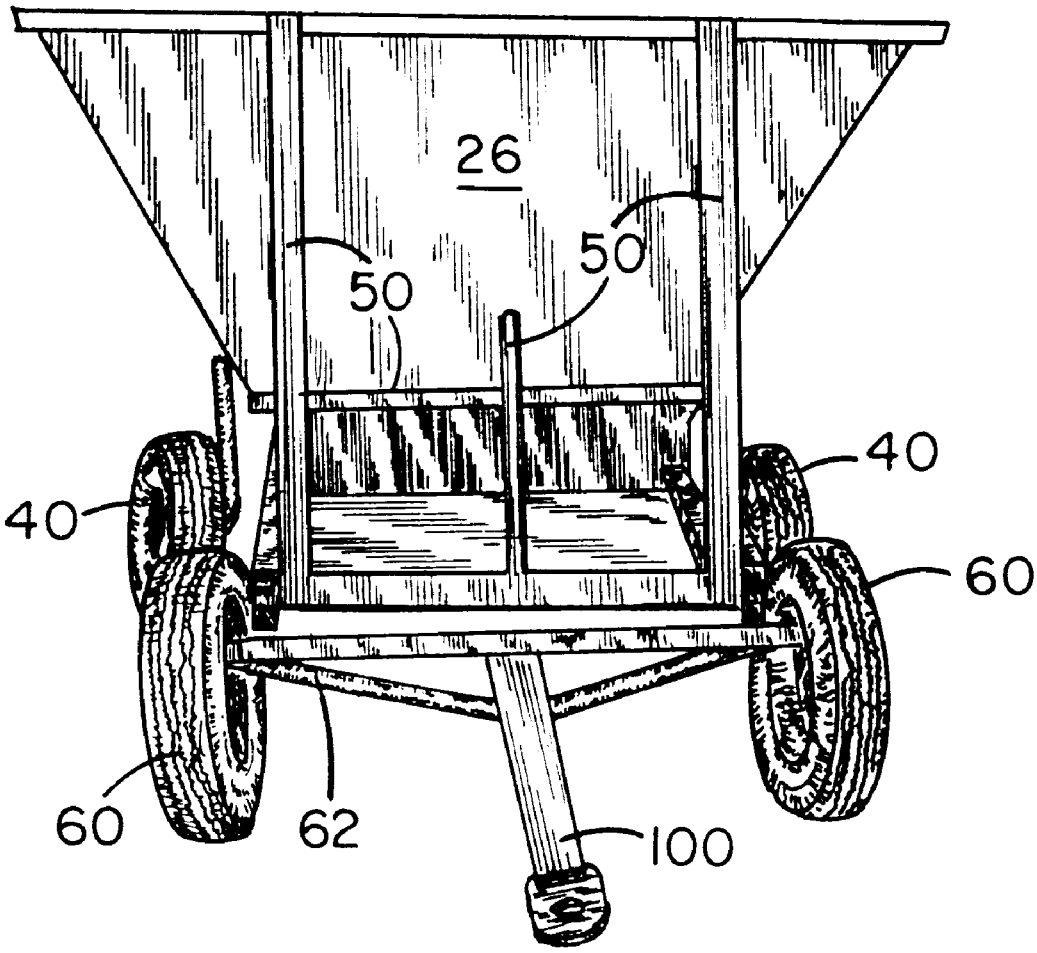
FIG. 5 is an elevational front view of one embodiment of the paver machine.
Figure 6:
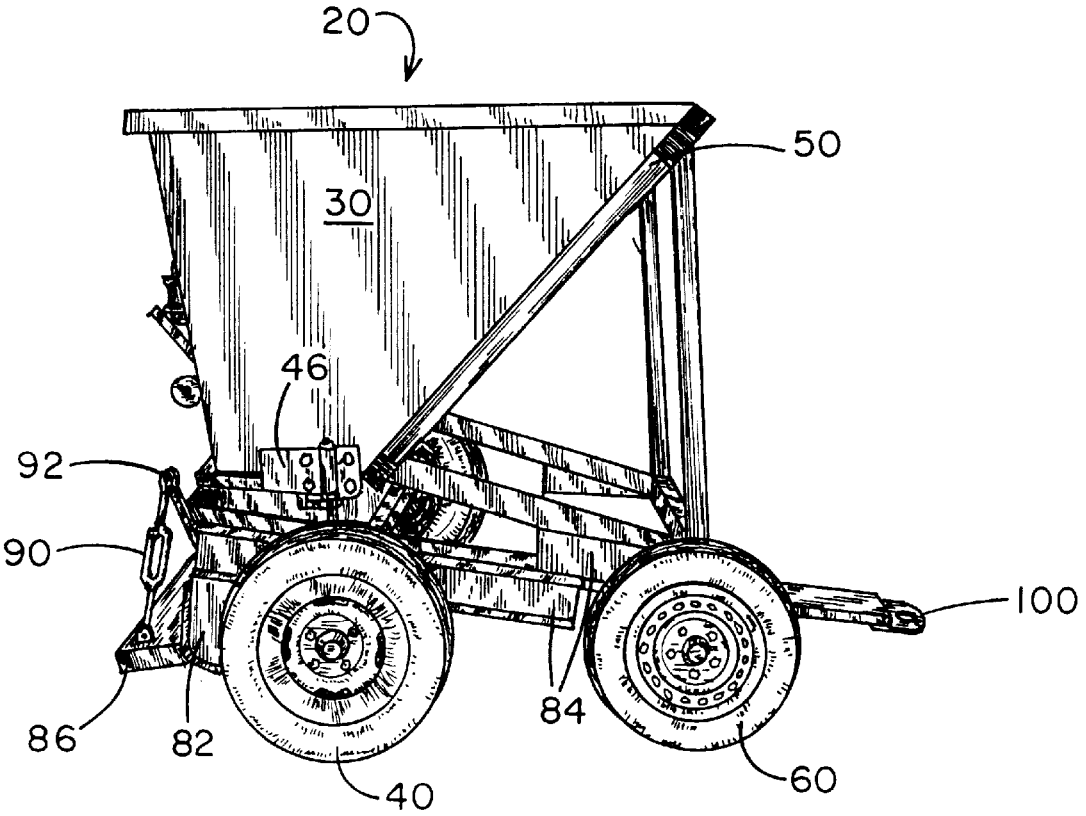
FIG. 6 is another elevational side view of one embodiment of the paver machine.
Figure 7:
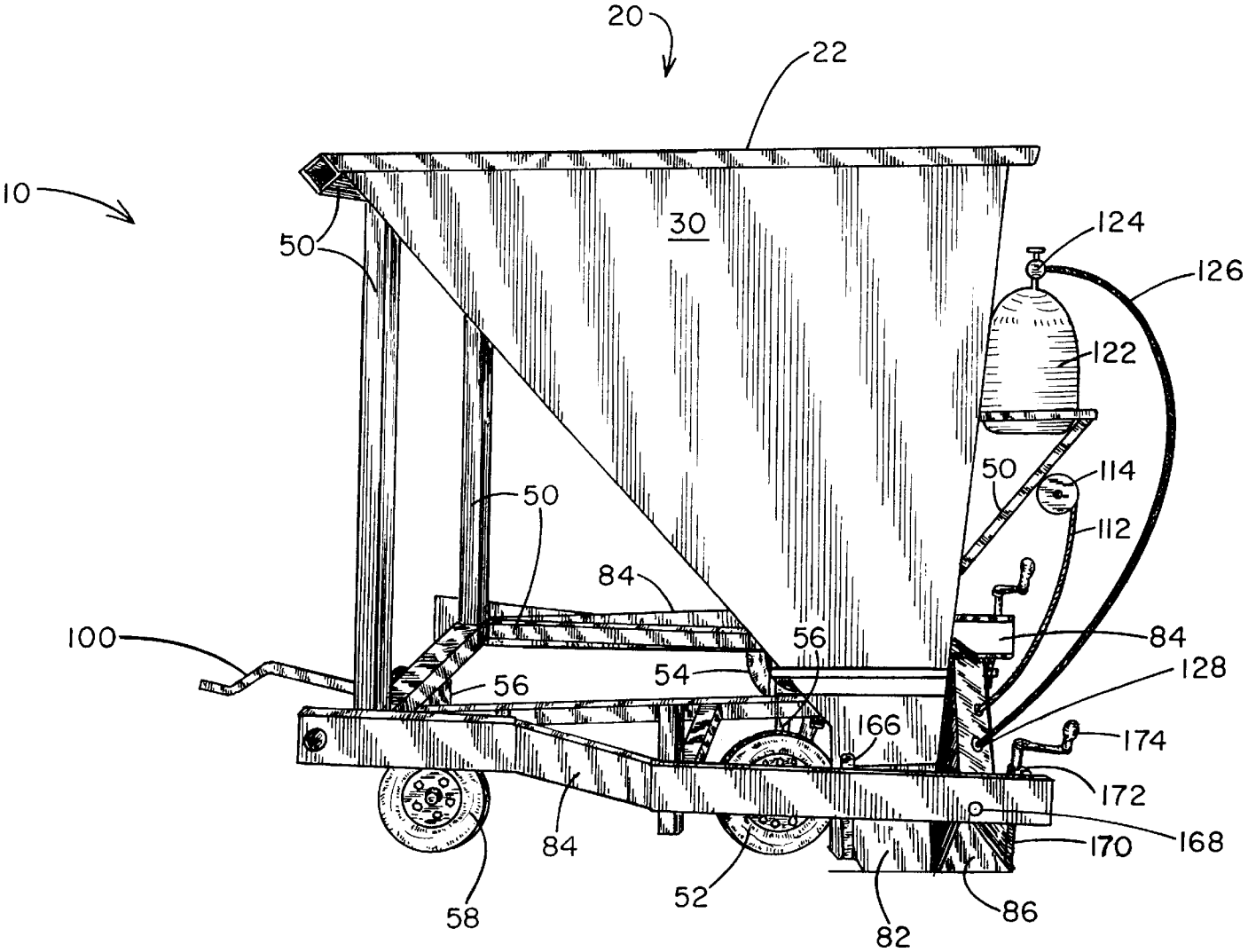
FIG. 7 is an elevational plan view of another embodiment of the paver machine of the invention.

The paver machine 10 is particularly well suited to the application of asphalt paving material to a roadbed. Asphalt is best applied as a hot mix having a consistency such that the asphalt material flows to some extent. FIG. 2 is a depiction in cross sectional view of the paving machine 10 during operation. Paving material P is loaded into the storage hopper member 20 from the open top end 22 and flows out the open bottom end 24 into the floating screed feed hopper member 72. Once in the feed hopper member 72, the paving material P flows to the open bottom end 76 and onto the roadbed RB. The paving material, such as hot mix asphalt, is prevented from flowing sideways by the two side panels 82 that are in contact with the roadbed RB. The front panel 78 and the rear panel 80 with attached screed plate 86 are spaced above the roadbed allowing the paving material to flow under them to some extent. As the paver machine 10 is pulled by the tongue hitch 100 along the roadbed, the paving material P flows out under the rear panel 80 of the feed hopper 70 and screed plate 86, attached thereto, with the paving material P continuously flowing from the storage hopper 20 to the feed hopper 72 and onto the roadbed RB.

The thickness of the paving material on the roadbed can be varied by changing the orientation of the screed plate 86 relative to the roadbed, employing turnbuckle adjusting members 90. Lowering the end of the screed plate 86 opposite the hinge connector 88 allows the floating screed assembly 70 to rise and lay down a thicker layer of paving material P on the roadbed. The side panels 82 maintain a straight side edge on the paving material matte P.

To transport the paver machine 10 from location to location, the free-floating screed assembly 70 is elevated above the roadbed surface RB by means of a cable assembly 110. The cable assembly 110 includes a cable 112 secured to the feed hopper rear panel 80 and connected to a winch 114 mounted to the frame member 50 there above. Rotating the winch 114 to draw up the cable 112 causes the screed assembly 70 to pivot upwardly via the pivot connection at the ends of the connecting arm members 84, secured near the front of the frame member 50. The cable 112 is left slack or is detached from the screed assembly 70 during operation of the paver machine 10.

When used for applying asphalt hot mix paving material, the paver machine 10 is optionally provided with a means for heating the screed plate 86 during startup to improve performance. The heating means described here is a propane torch assembly 120, including a propane storage tank 122 fitted with a regulator 124 and feed lines 126 to one or more burner heads 128 located at the screed plate member 86. When fitted with the propane torch assembly 120, the screed plate 86 is fabricated as a hollow rectangular structure with the burner heads 128 entering the top of the hollow, rectangular screed plate 86. Combustion of the propane fuel occurs within the hollow chamber of the screed plate 86. There are several vent holes 87 located at each end of the hollow screed plate member 86 to allow air to enter and combustion products from the torch burner heads 128 to escape. Once the paver machine 10 is in operation, the propane burner assembly 120 may be turned off since the hot mix paving material P moving through the paver machine 10 will maintain a suitable operating temperature for the hollow screed plate 86.

Likewise, it is desirable to have available a source of petroleum based liquid for cleaning the paver machine 10 after applying asphalt hot mix. The petroleum liquid wash assembly 130 includes a hand pump sprayer container, with diesel fuel therein, the sprayer fitted with a suitable nozzle. The assembly 130 can be carried on the paver machine 10 for convenience.

Figure 8:
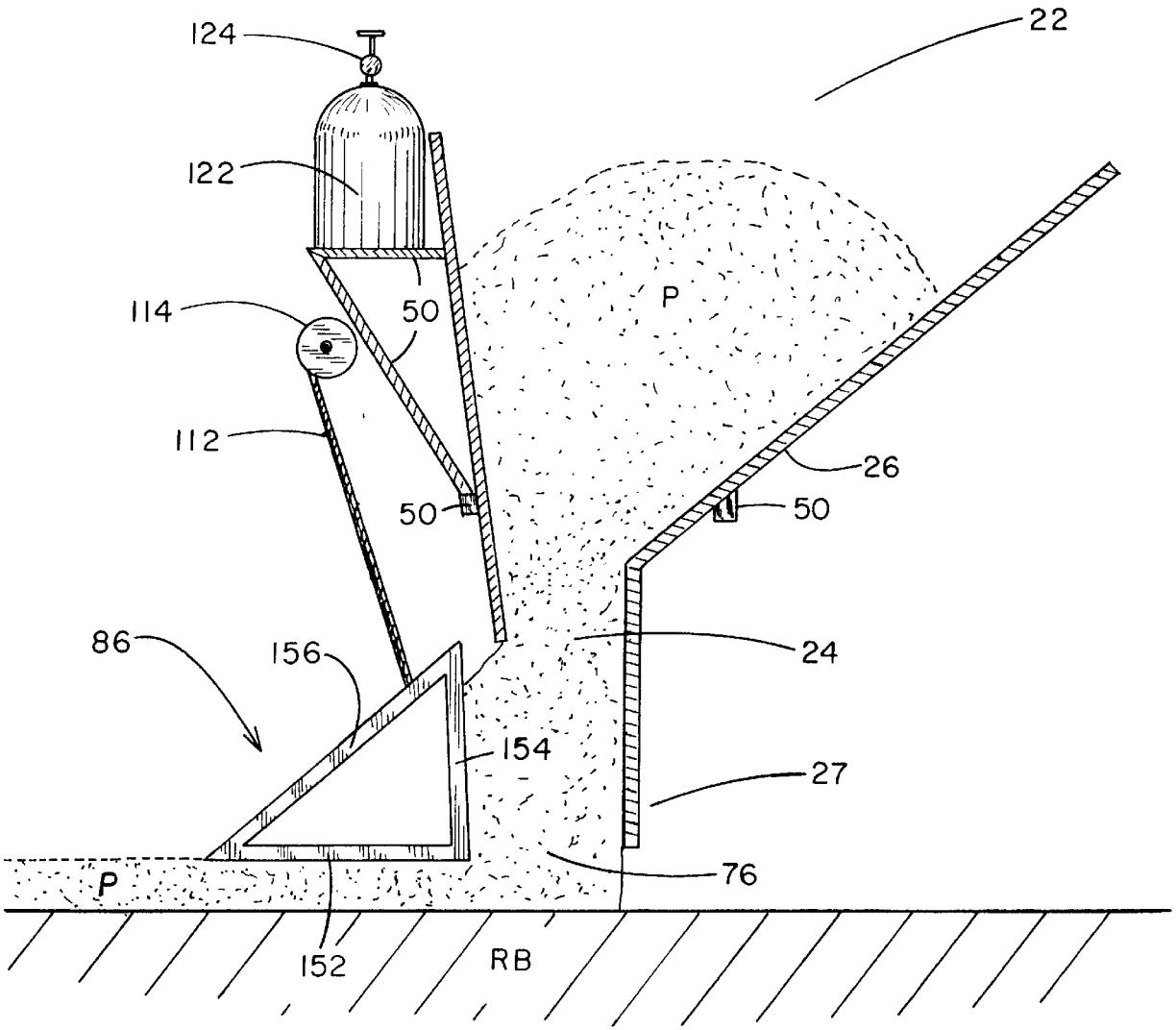
FIG. 8 is a sectional view of another embodiment of the paver machine during operation.
Figure 9:
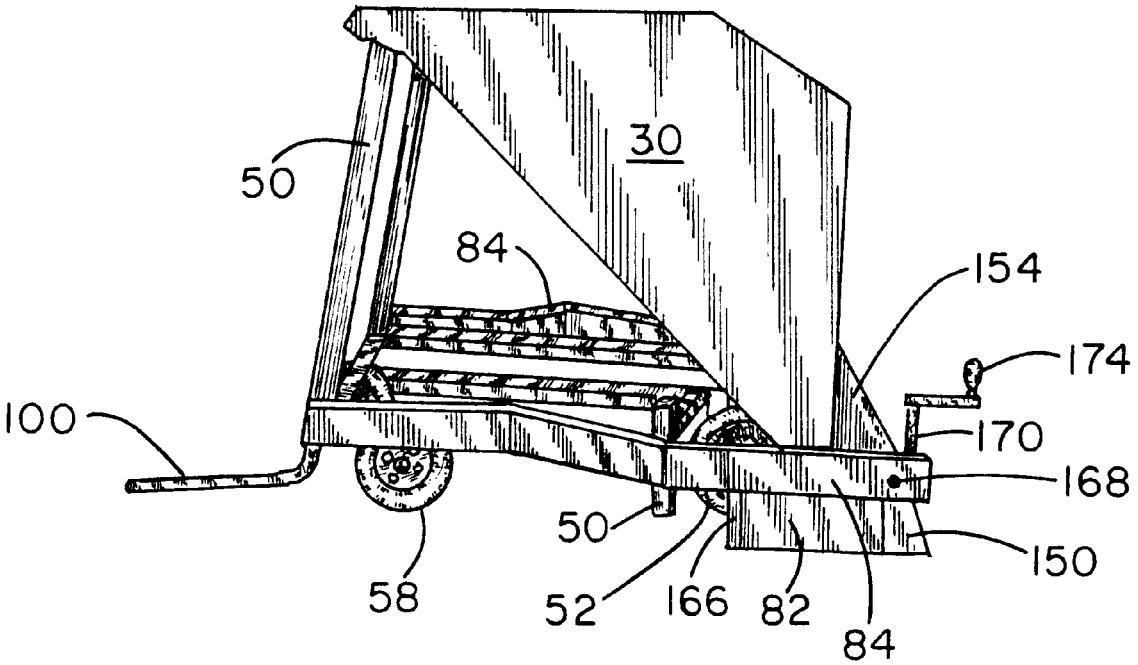
FIG. 9 is an elevational side view of another embodiment of the paver machine.
Figure 10:
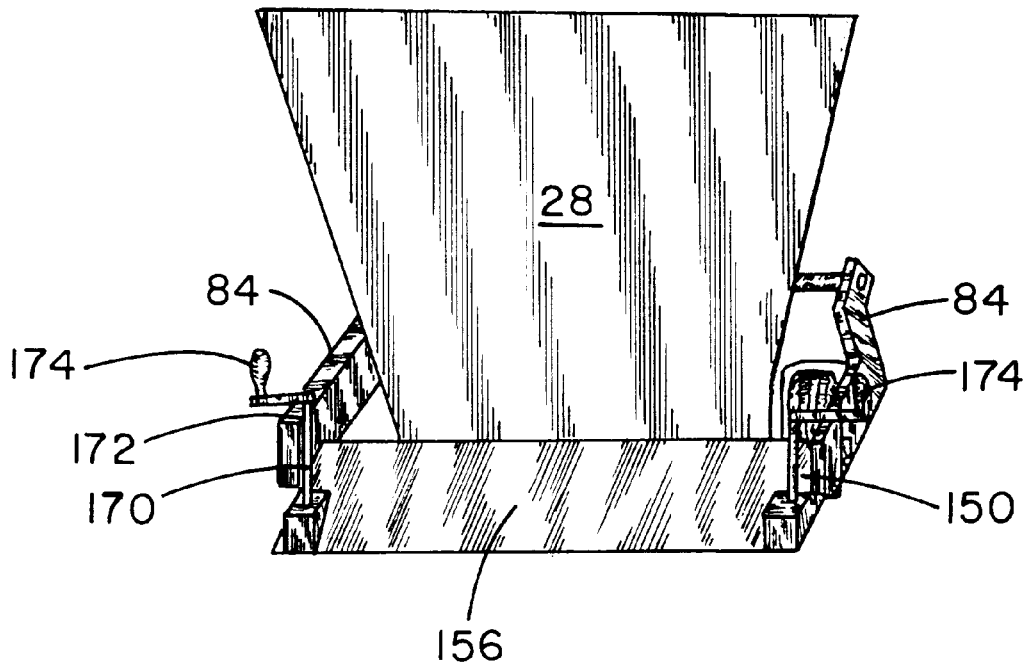
FIG. 10 is an elevational rear view of another embodiment of the paver machine.
Figure 11:
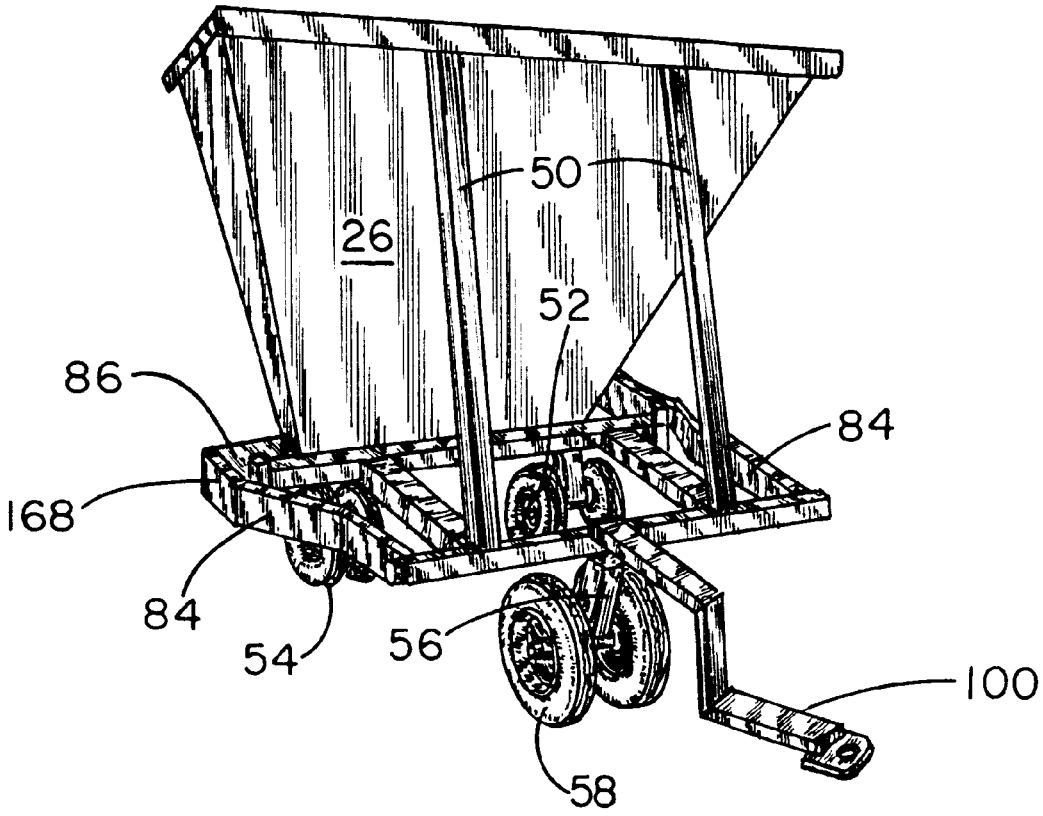
FIG. 11 is an elevational front view of another embodiment of the paver machine.
Figure 12:
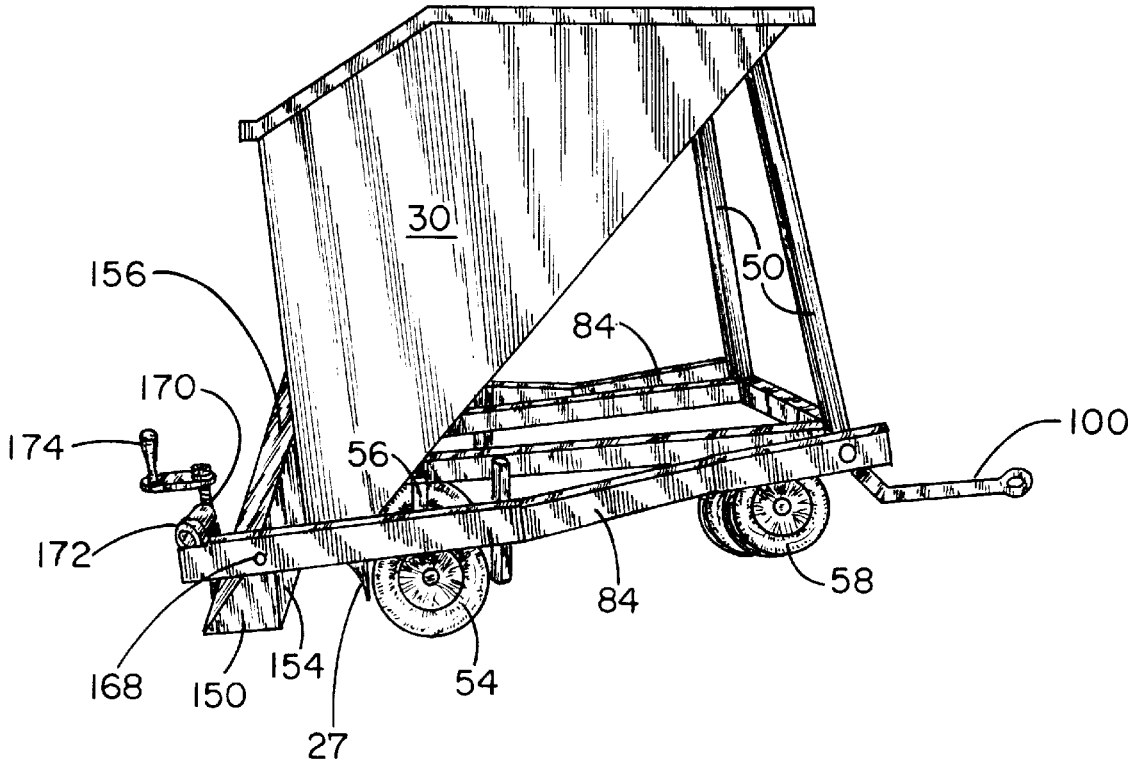
FIG. 12 is another elevational side view of another embodiment of the paver machine.

An alternative embodiment of the invention is shown in FIGS. 7–14 where similar components from FIGS. 1–6 have the same indica. The paver machine 10 comprises a hollow storage hopper member 20 with an open top end 22 and a smaller open bottom end 24. The storage hopper member 20 has a front panel 26, a rear panel 28, and two side panels 30. All the panels taper in size from the top end 22 to the bottom end 24 to funnel the paving material placed therein toward the bottom end 24. In this embodiment, the bottom end 27 of the front panel 26 extends beyond the bottom ends of the side panels 30, as seen in FIG. 8.

A frame member 50 supports the storage hopper 20 in an upright position. The frame member 50 is secured around the lower portion of the storage hopper 20 and extends forward, beyond the tapered hopper member front panel 26, as seen in FIGS. 7–12. The frame member 50 and attached storage hopper 20 are elevated a selected distance above the roadbed RB by at least three wheeled unit members. The first and second wheeled unit members 52, 54 are attached to the frame member 50 adjacent the storage hopper front panel 26 and at opposite sides thereof for stability. The first and second wheeled unit members 52, 54 are preferably two sets of dual wheels, with each set having a common axle and connected to the frame member 50 by a vertical wheel support member 56. A third wheeled unit member 58 is attached to the front of the frame member 50 opposite the storage hopper 20. The third wheeled unit member 58 is preferably a single set of dual wheels on a common axle. Preferably, the third wheeled unit member 58 is pivotally mounted at the center of the frame member 50, opposite the storage hopper 20. This positioning of the three wheeled unit members 52, 54, 58 provides a tripod of contact points for support of the storage hopper 20 and frame member 50. The pivotal mounting of the third wheeled unit member 58 provides for easy steering of the paver machine 10 during operation. This configuration of wheeled unit members produces a relatively open channel beneath the frame member 50 and the open end 24 of the storage hopper member 20. This is the location of the free-floating screed assembly 70.

In this embodiment, the free-floating screed assembly 70 is comprised of a pair of connecting arm members 84, with each arm member pivotally connected at one end to the frame member 50 at points adjacent to the third wheeled unit member 58. Each connecting arm member 84 extends rearward from the attachment point, with each arm member 84 positioned exterior the respective storage hopper side panels 30. Each connecting arm member 84 is pivotally fastened to one end 150 of the screed plate member 86 at an arm member end opposite the frame attachment end. The screed plate member 86 of this embodiment is a hollow member, triangular in cross section, with a flat bottom side 152, a vertical front side 154, and an angled top side 156, as seen in FIG. 8. The hollow screed plate member 86 is fitted with propane burner heads 128 for heating the screed member 86 during startup, as described earlier. The hollow screed plate member 86 is sized to extend beyond the side panels 30 of storage hopper bottom end 24.

Figure 13:
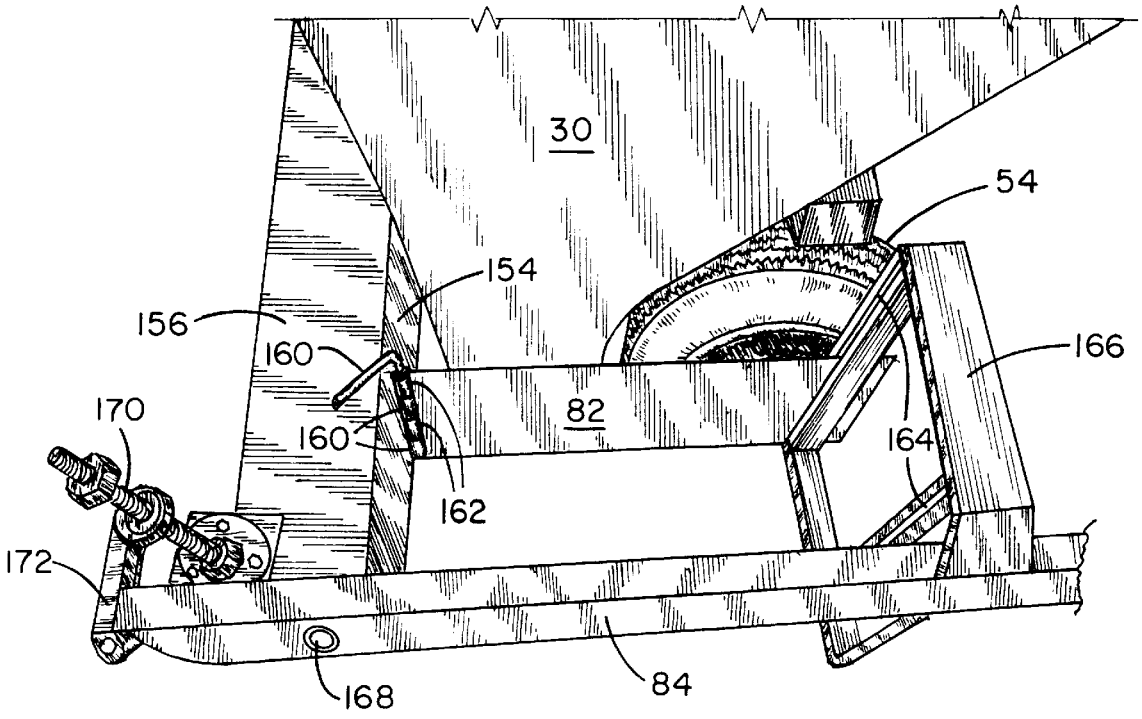
FIG. 13 is an elevational view of a portion of the screed assembly of the paver machine.
Figure 14:
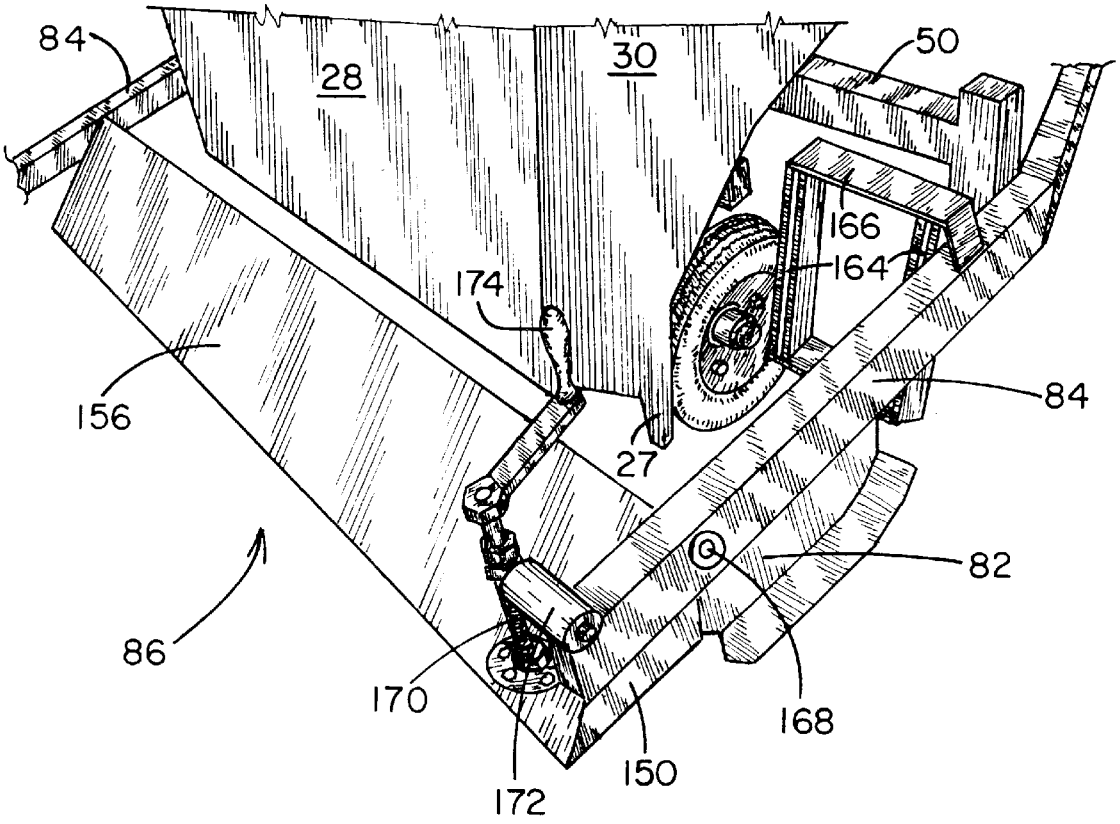
FIG. 14 is another elevational view of a portion of the screed assembly of the paver machine.

In this embodiment of the invention, the feed hopper member 72 for directing the paving material P onto the roadbed RB is composed of the storage hopper extended front panel 27, the vertical front side 154 of the triangular screed plate member 86, and a pair of feed hopper side panels 82, with each panel secured to the vertical front side 154 of the screed member, and to the connecting arm members 84, as shown in FIGS. 13 and 14.

In addition, each side panel member 82 can be located a preselected distance from the corresponding storage hopper side panel 30 to provide adjustment of the width of the paving material P applied to the roadbed RB. Each side panel member 82 is fitted at one end with a hinge and pin device 160 that connects with one of several hinge receiver devices 162 attached to the vertical front side 154 of the screed member 86. The end of each side panel member 82 opposite the hinge connector device 160 fits into one of several slots 164 in a bracket member 166 fastened to a connecting arm member 84, as illustrated in FIGS. 13 and 14.

The hollow triangular screed plate member 86 is pivotally fastened between the connecting arm members 86 by connecting members 168. The screed member 86 is fitted with adjusting means in the form of threaded shafts 170 secured to the angled top side 156 at each end thereof. The threaded shaft members 170 each pass through a threaded support member 172 and each has a handle member 174 on the top end thereof. Turning the handle member 174 moves the trailing edge of the triangular screed member 86 relative to the road bed RB, thereby varying the thickness of the paving material P laid down. The floating screed assembly 70 can be elevated above the roadbed RB by the cable assembly 110 for transport of the paver device 10 as described earlier. Thus, the embodiment of the invention in FIGS. 7–14 can lay down paving material P in a variety of widths by repositioning of the screed assembly side panel member 82 in the slots 164 of the bracket member 166.

Although the paver machine has been described with regard to the application of asphalt hot mix material to a roadbed RB, the paver machine 10 of the present invention is suitable for applying roadbed gravel, sand, crushed rock or the like in preparation for paving a path. The paver machine is also suitable for laying concrete on a roadbed. The burner assembly 120 would not be needed for these applications of the paving machine 10.

While the invention has been particularly shown and described with reference to a preferred embodiment thereof, it will be understood by those skilled in the art that various changes in form and details may be made therein without departing from the spirit and scope of the invention.

I claim:

1. A gravity feed free-floating screed paving machine for applying paving material to a roadbed comprising;

(a) a hollow storage hopper member with an open top end and a smaller open bottom end, said hopper member having front and rear panels and two side panels, all panels tapering in width from said hopper member top end to said hopper member bottom end;

(b) a frame member supporting said storage hopper, said frame member and attached storage hopper member elevated a selected distance above the roadbed by at least three wheeled unit members, a first and a second wheeled unit member attached adjacent said storage hopper open bottom end in support thereof, and at least one third wheeled unit member attached to said frame member opposite said storage hopper open bottom end;

(c) a free-floating screed assembly positioned below said elevated storage hopper member and elevated frame member, said screed assembly comprising;

(i) a feed hopper means positioned in register with said storage hopper open bottom end;

(ii) a pair of connecting arm members connecting said feed hopper means to said frame member, each connecting arm member extending from said feed hopper means and each arm member pivotally connected at an end opposite said feed hopper means to said frame member at a point adjacent said at least one third wheeled unit member;

(iii) an adjustable screed plate member fastened between said connecting arm members and positioned adjacent said rear panel of said storage hopper bottom end;

(iv) adjusting means to vary the orientation of said screed plate member relative to the road bed; and (d) a floating hitch means secured to and extending from said frame member opposite said storage hopper member for attachment to means for pulling said paving machine over the roadbed.

2. A paving machine according to claim 1 wherein, said first and second wheeled unit members are each connected to one of said storage hopper side panels.

3. A paving machine according to claim 1 wherein, said first and second wheeled unit members are each connected to said frame member adjacent said storage hopper open bottom end.

4. A paving machine according to claim 1 wherein, said first and second wheeled unit members are each dual wheel assemblies fastened to wheel support strut members connected to said frame member.

5. A paving machine according to claim 1 wherein, said at least one third wheeled unit member comprises an axle member fastened to said frame member with a wheel member on each end thereof.

6. A paving machine according to claim 1 wherein, said at least one third wheeled unit member comprises a dual wheel assembly on a wheel support strut member, said third wheeled unit member positioned in the center of said frame member.

7. A paving machine according to claim 6 wherein, said at least one third wheeled unit member is pivotally connected to said wheel support strut member opposite said storage hopper open bottom end.

8. A paving machine according to claim 1 wherein, said feed hopper means comprises a rectangular feed hopper member with an open top end and a smaller open bottom end, said feed hopper member having front and rear panels and two side panels, each side panel fastened to one connecting arm member.

9. A paving machine according to claim 8 wherein, said adjustable screed plate member is a planar member pivotally secured at one edge to said feed hopper member rear panel at a bottom edge thereof.

10. A paving machine according to claim 9 wherein, said adjusting means comprises threaded turn buckles positioned between said screed plate member and said connecting arm members.

11. A paving machine according to claim 1 wherein, said adjustable screed plate member comprises a hollow member of triangular cross section, said hollow triangular member having a flat bottom side, a vertical front side and an angled top side, said hollow triangular member pivotally secured between said pair of connecting arm members.

12. A paving machine according to claim 11 wherein, said feed hopper means comprises a bottom extended portion of said front panel of said storage hopper member, said vertical front side of said hollow triangular screed plate member, and two side panel members, each panel member reversibly fastened to said screed plate member vertical front side and to a connecting arm member.

13. A paving machine according to claim 1 further comprising, means for adjusting the position of said side panel members relative to said bottom end of said storage hopper member.

14. A paving machine according to claim 1 further comprising, means for elevating said screed assembly relative to the roadbed for transportation of said paving machine.

15. A paving machine according to claim 1 further comprising, means for heating said screed plate member.

16. A paving machine according to claim 15 wherein, said heating means comprises at least one burner head mounted adjacent said screed plate member, with combustible fuel supply means providing fuel to said burner head.

17. A gravity feed free-floating screed paving machine for applying paving material to a roadbed comprising;

(a) a hollow storage hopper member with an open top end and a smaller open bottom end, said hopper member having front and rear panels and two side panels, all panels tapering in width from said hopper member top end to said hopper member bottom end;

(b) first and second wheeled unit members, each wheeled unit member attached to one hopper side panel near said smaller bottom end thereof, whereby said hopper member is elevated a selected distance above said road bed;

(c) a frame member supporting said storage hopper member and wheeled unit members attached thereto, said frame member extending beyond said tapered hopper member front panel, said frame member elevated a selected distance above the roadbed by a third wheeled member unit comprising a pair of wheel members, each wheel member rotatably attached to an axle fastened to said frame member;

(d) a free-floating screed assembly positioned below said elevated storage hopper and elevated frame member and between said first and second wheeled unit members and pivotally connected to said frame member, said screed assembly comprising;

(i) a generally rectangular feed hopper member with an open top end and smaller open bottom end, said feed hopper member having front and rear panels and two side panels, said feed hopper member positioned with open top end in register with said storage hopper open bottom end;

(ii) a pair of connecting arm members, one arm member extending from each feed hopper member side panel, each arm member pivotally connected to said frame member at a point adjacent said frame wheel members;

(iii) an adjustable, generally flat, rectangular screed plate member pivotally secured at one edge to said feed hopper rear panel at a bottom end thereof;

(iv) adjusting means to vary the orientation of said flat screed plate member relative to the road bed; and (e) floating hitch means secured to and extending from said frame member opposite said storage hopper member for attachment to means for pulling said paving machine over the roadbed.

18. A gravity feed free-floating screed paving machine for applying paving material to a roadbed comprising;

(a) a hollow storage hopper member with an open top end and a smaller open bottom end, said hopper member having front and rear panels and two side panels, all panels tapering in width from said hopper member top end to said hopper member bottom end;

(b) a frame member supporting said storage hopper, said frame member and attached storage hopper member elevated a selected distance above the roadbed by at least three wheeled unit members, a first and a second wheeled unit member attached to said frame member adjacent said storage hopper open bottom end in support thereof, and a third wheeled unit member pivotally attached to said frame member opposite said storage hopper open bottom end;

(c) a free-floating screed assembly positioned below said elevated storage hopper member and elevated frame member, said screed assembly comprising;

(i) a feed hopper means positioned in register with said storage hopper open bottom end;

(ii) a pair of connecting arm members connecting said feed hopper means to said frame member, each connecting arm member extending from said feed hopper means and each arm member pivotally connected at an end opposite said feed hopper means to said frame member at a point adjacent said third wheeled unit member;

(iii) an adjustable, hollow, triangular screed plate member pivotally fastened between said connecting arm members and positioned adjacent said rear panel of said storage hopper bottom end;

(iv) adjusting means to vary the orientation of said screed plate member relative to the road bed; and (d) a floating hitch means secured to and extending from said frame member opposite said storage hopper member for attachment to means for pulling said paving machine over the roadbed.

19. A paving machine according to claim 18 wherein, said feed hopper means comprises a bottom extended portion of said front panel of said storage hopper member, a vertical front side of said hollow triangular screed plate member, and two side panel members, each panel member reversibly fastened to said screed plate member vertical front side and to a connecting arm member.

20. A paving machine according to claim 19 further comprising, means for adjusting the position of said side panel members relative to said bottom end of said storage hopper member.

* * * * *